US005186358A

United States Patent [19]

McVay

[11] Patent Number: 5,186,358

[45] Date of Patent: Feb. 16, 1993

[54] SPOUT DEVICE AND KIT COMBINATION

[76] Inventor: Clifford R. McVay, P.O. Box 5041, Sparks, Nev. 89432-5041

[21] Appl. No.: 613,294

[22] Filed: Nov. 15, 1990

[51] Int. Cl.[5] ..... B67D 5/06

[52] U.S. Cl. ..... 222/1; 222/181; 222/450; 222/529; 222/568; 141/332; 141/344

[58] Field of Search ..... 222/181, 529, 545, 567, 222/568, 450, 1; 141/331, 332, 334, 344, 345

[56] References Cited

U.S. PATENT DOCUMENTS

| | | | |
|---|---|---|---|
| 168,508 | 10/1975 | Leland | 141/331 |
| 1,520,637 | 12/1924 | Frank | 222/450 |
| 3,344,958 | 10/1967 | Kaanehe | 222/181 |
| 4,031,032 | 6/1977 | Jablecki | 141/344 |
| 4,187,930 | 3/1980 | James | 222/566 |
| 4,227,629 | 10/1980 | Froyman | 222/566 |
| 4,426,027 | 1/1984 | Maynard | 222/529 |
| 4,493,443 | 4/1985 | Bailey | 222/529 |
| 4,600,125 | 7/1986 | Maynard, Jr. | 141/331 |
| 4,802,610 | 8/1989 | Check et al. | 222/481.5 |
| 4,809,870 | 3/1989 | Goodall | 222/568 |
| 4,832,238 | 5/1989 | Taylor | 222/529 |
| 4,884,600 | 12/1989 | Neilson | 141/1 |
| 4,946,079 | 8/1990 | Campbell | 222/568 |
| 5,000,360 | 3/1991 | Lown et al. | 222/568 |
| 5,020,702 | 6/1991 | James | 222/529 |

FOREIGN PATENT DOCUMENTS

| | | | |
|---|---|---|---|
| 2450781 | 11/1980 | France | 222/450 |

*Primary Examiner*—Gregory L. Huson

[57] ABSTRACT

A spout device, which may be hand held or wall mounted, for use in dispensing containerized fluids or liquids, powders and granulated solids. Included with the device is a kit comprised of a variety of attachable and detachable components which enables the device to be connected to virtually all containers with contents to be discharged.

14 Claims, 4 Drawing Sheets 32
34

48
44

46
38

36
42
40

24
20
30
60
22

74
72
70

86
62
65
88
80
82
78
84
26
76

89
68
66
29

28

SPOUT DEVICE AND KIT COMBINATION

BACKGROUND OF THE INVENTION

This invention relates to a spout device, and more specifically to a spout device and kit for discharging a variety of containerized items such as fluids or liquids, powders and granulated solids which I will refer to as elements.

For some years now, a great variety of elements are being placed into a great variety of containers with as many varieties and sizes of pouring members through which contents pass when being discharged. As I have personally experienced, dispensation of elements from these containers present a problem and oftentimes result in messy spills. Because of this inconvenience, I decided to solve the problem for myself as well as for the general public and solving this problem is the major focus of my invention. Accordingly, the need to provide a product which represents the solution introduced the following.

This purposeful invention is intended to be the most convenient, versatile and encompassing product on the market today while addressing the heretofore mentioned problem. To achieve these intentions, my invention includes a spout type unit which allows a user to discharge elements from practically any container currently in use. To accomplish this, I include with my invention a kit which is comprised of a variety of attachable and detachable components to be utilized in conjunction with the spout device. More specifically, these components comprise a combination of items including caps for holding snugly into place, within the upper chamber portion of the spout device, a variety of inserts (which are described as plugs in the appended claims), with openings, with these inserts capable of receiving the neck or pouring member of containers having practically any diameter currently being manufactured. The component list further includes adaptors for attachment to various plugs included in the kit and to a variety of neck sizes of various containers. There is further included in the kit an extension(s) with an on/off mechanism therein for additional control of element dispensation. Also included in the kit is a dust plate(s) which may be placed upon the extreme upper portion or opening of the spout device and a cap is then screwed onto this upper portion thus holding the dust plate securely in place.

The heretofore mentioned components comprise a variety of sizes, shapes, dimensions and designs and are manufactured utilizing a variety of materials and compositions of materials. In addition, the spout device contains one or more on/off mechanisms for achieving a controlled dispensation method of discharging containerized elements.

A further convenience item included with my invention is a holding unit with bracket and this unit may be wall mounted so that the spout body can be readily attached to or detached from the holding unit.

As heretofore mentioned, my invention is such that it is designed to be encompassing. That is, the invention goes beyond prior art and addresses dispensation of a majority of containerized elements. Prior art indicates various articles which have been introduced to help solve certain dispensation problems but they fall short of providing a unit which accomplishes the versatility of my invention. Various spout and funnel inventions, many outdated because of technology (for example, the demise of the cylindrical oil can), reveal that a prospective buyer would be obliged to purchase an assortment of items, many bulky and awkward, to achieve what my invention accomplishes.

To enlighten the reader as to the benefits of my invention, I create this scenario. My invention could be disconnected from its wall mount where it was being used in an in-house situation, then taken outside by its owner, Mr. User (a chemist and a do-it-himself chap), and used by him to change motor oil, add automatic transmission fluid (this has historically been a problem because of the inaccessability of the filler tubes), add antifreeze to the radiator, add power steering fluid, add brake fluid, add windshield washer solution, and add a fuel mixture. All of the above mentioned functions without spillage and without funnel usage or the purchase of a variety of devices such as nozzles and pouring units. The spout device could then be cleaned (as it should be between functions) and taken back in-house to continue dispensing containerized chemicals in the owner's home laboratory where the wall mount is utilized. Of course, this theoretical owner probably has a unit mounted in his garage or shop so that his wall full of laboratory units could stay in place. Mr. User's friend, a baker, does have my invention wall mounted in his garage because he is not allowed to use his bakery spout devices for automotive purposes because of health department regulations. Mr. Baker's wife, who has one wall mounted in her kitchen, will not allow him to use hers for about the same reason!

The principal object of the present invention is to provide a device which is the most purposeful, convenient, versatile and encompassing dispensing unit for today's market and for the future.

It is also an object of the present invention to provide an improved device for use in discharging containerized elements in any quantity and in a controlled manner.

It is a further object of this invention to provide connectors for attachment of the spout device to a plurality of containers.

It is still a further object of this invention to provide accessories to be utilized in conjunction with the spout device to prevent spillage when discharging elements from containers.

It is still a further object of this invention to provide a wall mounting capability for the spout device for in-house usage.

Still other objects and advantages of this invention will be apparent to those skilled in the art upon reference to the following detailed description and the accompanying drawings, wherein.

DETAILED DESCRIPTION OF THE PREFERRED EMBODIMENTS

Since the invention comprises a variety of embodiments, it will be necessary to explain various procedures which will result in a successful method for discharging elements, all or in part, from a vast majority of containers.

Figures 1, 2, 3, 4, 5, 6, 7, 8:
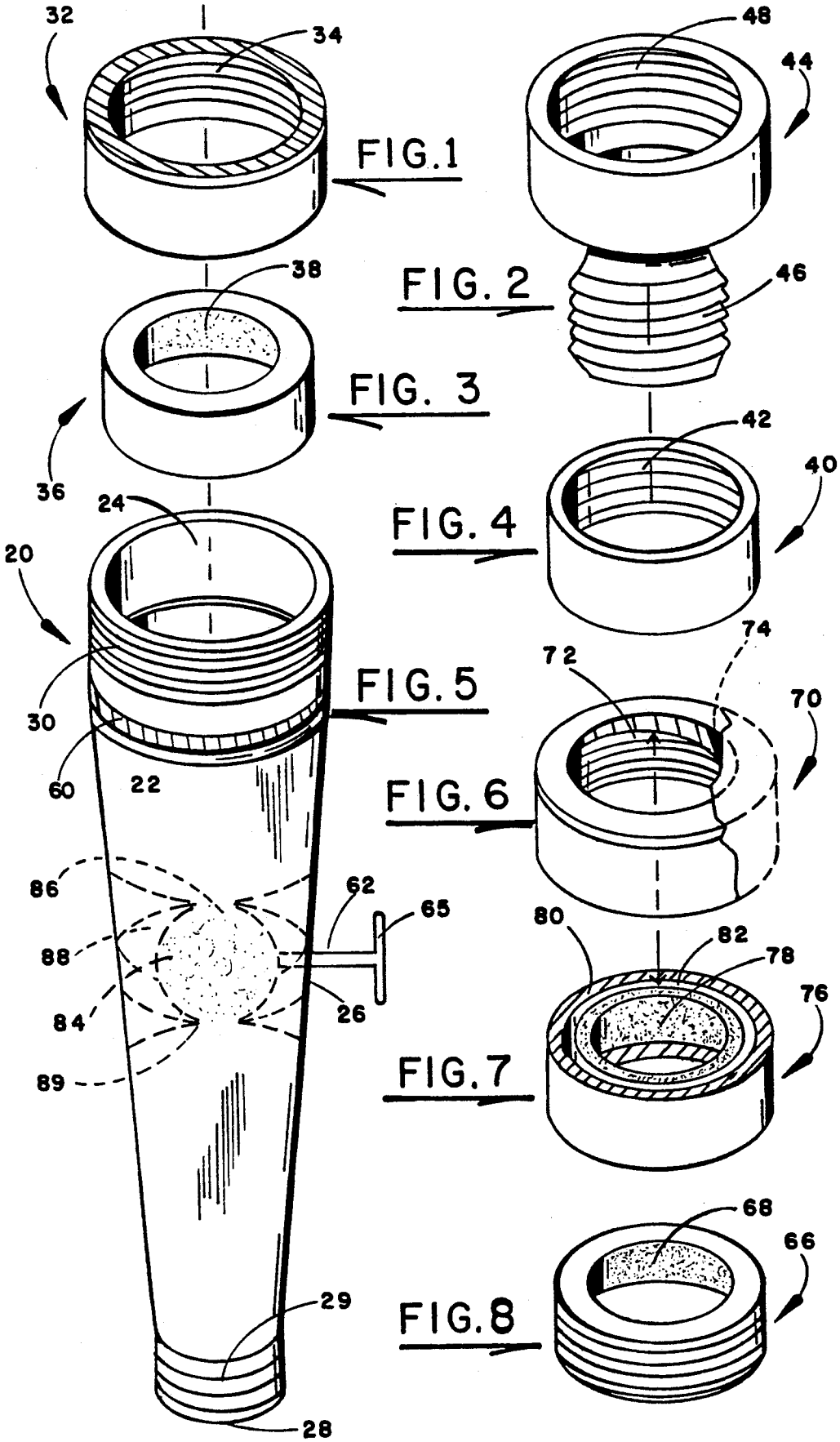
FIG. 1 is a perspective view of an interiorly threaded cap.
FIG. 2 is a perspective view of an adaptor with exterior threading on its lower portion and interior threading within its upper portion.
FIG. 3 is a perspective view of a nonthreaded plug.
FIG. 4 is a perspective view of an interiorly threaded plug and a broken line is seen drawn up to FIG. 2 to indicate a connection method.
FIG. 5 is a perspective view of the spout body with exterior threading on its upper and lower portions and indicates a continuous elongated protrusion immediately below the exterior threading of the upper portion.
FIG. 6 is a perspective view of an interiorly threaded cap with a cut-away indicating the continuous wedge-shaped protrusion permanently affixed to the underside of the cap.
FIG. 7 is a perspective view of the combination of materials plug which consists of an outer area of substantially rigid material and an inner area of flexible, resilient material where the wedge-shaped protrusion of FIG. 6 is forced between the two areas as indicated by a broken line seen drawn up to the wedge-shaped protrusion in FIG. 6.
FIG. 8 is a perspective view of an exteriorly threaded plug.
Figures 9, 10, 11, 12:
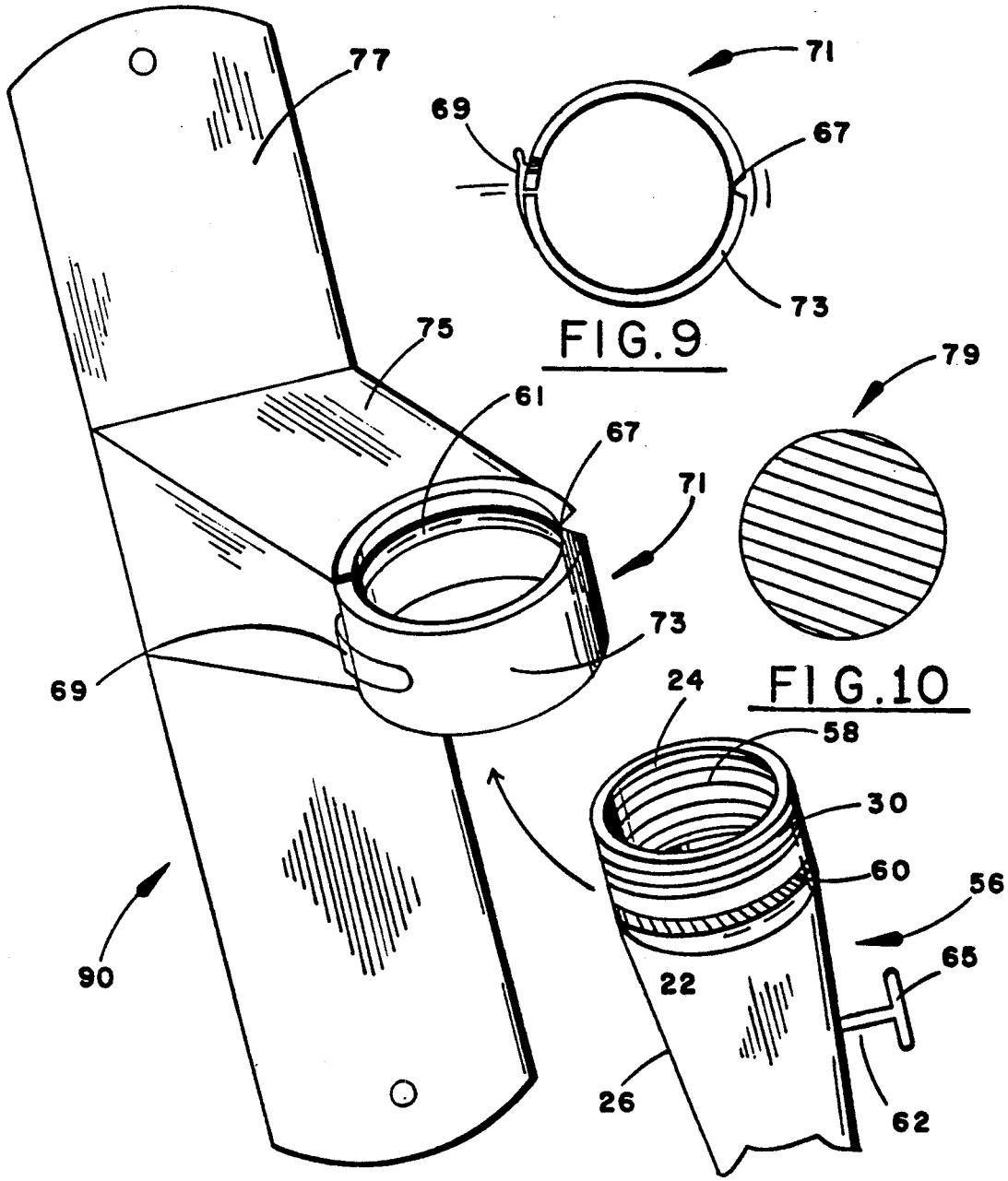
FIG. 9 is a plan view of the hinged circular shaped bracket with a locking apparatus.
FIG. 10 is a plan view of the dust plate.
FIG. 11 is a perspective view of the complete holding member for wall mounting the spout device including the bracket seen in FIG. 9.
FIG. 12 is a fragmentary perspective view of the spout device comprising interior threading within its upper chamber portion, threading on the exterior portion of the upper chamber, a protrusion below the exterior threading, and the actuating member and its attached handle protruding from the side of the spout body.
Figure 17:
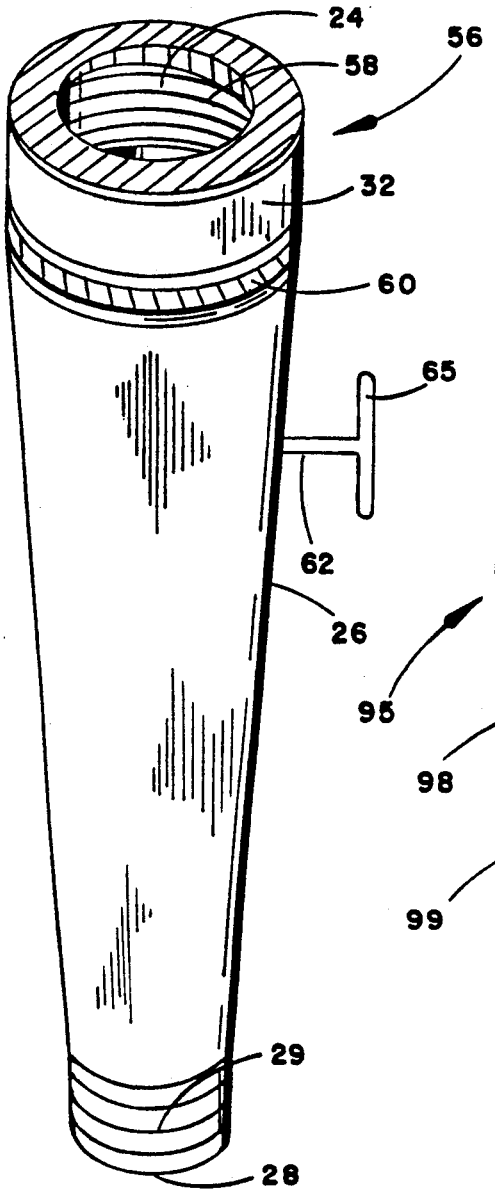
FIG. 17 is a perspective view of the spout device in its entirety with the cap shown affixed to the upper portion of the spout body and is shown with an empty chamber so that the interior threading for receiving exteriorly threaded plugs is illustrated.
Figure 19:
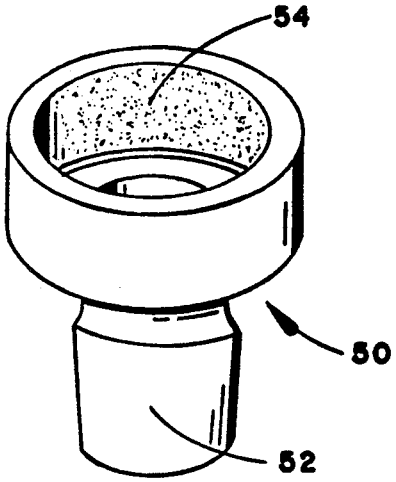
FIG. 19 is a perspective view of an adaptor which attaches to a plug at its lower portion and further attaches to a container neck at its upper portion.

To begin, the buyer of my invention examines the entire contents of his purchase and will read enclosed instructions. He or she most likely would begin by attaching the surface holding unit, as seen in FIG. 11, to a wall surface in her utility room, in this scenario. Let us assume that she has purchased a gallon container of liquid soap for her clothes washer and wishes to discharge one cup of this soap with each wash. She removes the cap and then examines the threaded pouring member of the soap container to determine its approximate diameter. Upon doing this, she further examines the kit included in her purchase comprising caps, inserts (which hereinafter I will refer to as plugs as is referred to in the appended claims) and adaptors. Here some choices begin:

a) Choose the plug 36 which is made of a flexible, resilient material and is comprised of a relatively smooth construction at its extreme outside circumferential surface, as seen in FIG. 3, with a nonthreaded opening 38 having a relatively smooth circumferential surface through its depth. In addition, this particular plug 36, which she might then choose, would have an inside diameter slightly smaller than the threaded pouring member of the soap container so that a tight seal is achieved when plug 36 is attached to the threaded member of the soap container by a push/twist action after cap 32, as seen in FIG. 1, is screwed onto threads 30, located on the outside of upper portion 24 of spout body 22, by cap 32 interior threading 34. However, previous to this described procedure, plug 36 was inserted into the chamber of upper portion 24 thus being contained and compressed within the chamber by cap 32.

b) Choose the plug 40 made of a substantially rigid material and is comprised of a relatively smooth construction at its extreme outside circumferential surface, as seen in FIG. 4, with a threaded opening 42 so that the plug 40 will attach precisely to the soap container. Plug 40 would then be inserted into the chamber of upper portion 24 of the spout body 22 and cap 32 would be affixed by following the same procedure in a) above.

c) Choose the plug 36 of a) above or the plug 40 of b) above and choose then the adaptor 44 as illustrated in FIG. 2. Each threaded adaptor 44 will have a constant exteriorly threaded diameter at its lower portion 46 so that only one specific plug within the kit would be utilized for this function. That is, only plug 36 with its opening 38, slightly smaller than the adaptor lower portion 46, would be used or only plug 40, with its threaded opening 42 precisely threaded to fit the adaptor lower portion 46, would be used. Each adaptor 44 would, however, contain a varied interiorly threaded opening diameter at its upper portion 48. Therefore, upon choosing the appropriate plug, she would then choose the adaptor with the proper interiorly threaded upper portion opening diameter 48 to be fitted to the soap container.

d) In the event adaptor 50, as seen in FIG. 19, is chosen to be fitted to plug 36 or fitted to plug 40, procedure c) above would be repeated. Adaptor 50 would have a tapered, variable diameter at its lower portion 52 and would contain a variety of upper portion openings 54 for attachment to various container pouring member diameters by a push/twist action. (It is of importance to explain, here, a push/twist action-it is believed that threading of a substantially rigid nature interacting with a receiving member of flexible, resilient material will create temporary threading within the flexible, resilient material resulting in a leakproof seal).

e) In the event spout device 56 is utilized, as is illustrated in FIG. 12 and FIG. 17, interior threading 58 of upper portion 24 would receive exteriorly threaded plug 66, as seen in FIG. 8, and plug 66 is made of a flexible, resilient material. She would choose the plug which has a slightly smaller inside opening diameter 68 than the outside diameter of the pouring member of the soap container for attachment by a push/twist action (Plug 66, although not shown, could have threading at its inside opening 68). Note that cap 32 is not utilized (caps will be described in a subsequent portion of this description) when choosing the plug 66 method since the plug is exteriorly threaded and will then be affixed to and contained within the chamber of upper portion 24 by threading 58 with no cap necessary for retaining this plug. Cap 32 is utilized in conjunction with spout device 20, which has a nonthreaded upper portion 24 chamber, for retaining plugs with a relatively smooth construction at their extreme outside circumferential surfaces therefore nonthreaded exteriorly.

f) In the event that our housewife, in this continuing scenario, has purchased a soap container with an odd sized pouring member and none of the plug components seem to be of workable combinations, included then in the kit are cap(s) 70 and plug(s) 76, as illustrated in FIG. 6 and FIG. 7 respectively. She would choose a plug which has an inside opening slightly larger than the diameter of the soap container pouring member. Because of the construction of plug 76 is comprises, in combination, a substantially rigid material comprising its outer circumferential area 80 and a flexible, resilient inner circumferential area 78 so that when the wedge-shaped protrusion 74, as illustrated in FIG. 6, and permanently affixed to the underside of cap 70, is forced into area 82 between area 80 and area 78 by a tightening action when cap 70 is screwed onto exterior threads 30 of the spout body 22 by interior cap threading 72, the inner area 78 is then compressed inward towards the pouring member of our subject soap container thus forming a tight seal.

Hopefully, our subject housewife, in this completed scenario, did successfully complete the attachment process and is now dispensing the soap from its container in a convenient and controlled manner.

I would like to note that because of the great variety of neck or pouring member shapes, sizes and dimensions affixed to containers, it is necessary to assume that other variations of pouring members will occur in the future. It must then be pointed out to and understood by those concerned or skilled in the art that components and accessories included in the kit of this invention will be updated to accommodate these future variations.

Also, I will add here that flexible, resilient plugs and adaptors would most likely be utilized for rapid attachment and detachment purposes such as changing motor oil. Containers which would be attached to the spout device and the device inverted and contained within the holding bracket 71 of the surface holding unit 90, as illustrated in FIG. 11, for a more lengthy time period (as the soap container in my scenario above) would probably be connected by threaded components unless a particular container neck is nonthreaded exteriorly.

Referring now to the drawings and more particularly to FIG. 5, the device 20 of the invention includes a generally tapered hollow spout body 22 provided with opened upper and lower ends. The body 22 includes an upper portion 24, of relatively large diameter, containing a nonthreaded chamber; an intermediate portion 26, containing one or more on/off mechanisms, which tapers inward as it extends downward; and a lower portion 28 of relatively small diameter. Upper portion 24 is provided with external threads 30. The cap 32, as illustrated in FIG. 1, is provided with internal threads 34 so that cap 32 is screwed into position with internal threads 34 screwed onto the external threads 30 of the upper portion 24. Prior to the cap attachment procedure, a plug was inserted into the upper portion 24 chamber and is now held securely in place by cap 32. Adaptor 44, as seen in FIG. 2, or adaptor 50, as seen in FIG. 19, could then be attached to the secured plug if necessary for a successful connection to a container. Refer back to examples a) thru f) for more detailed procedures.

Figure 14:
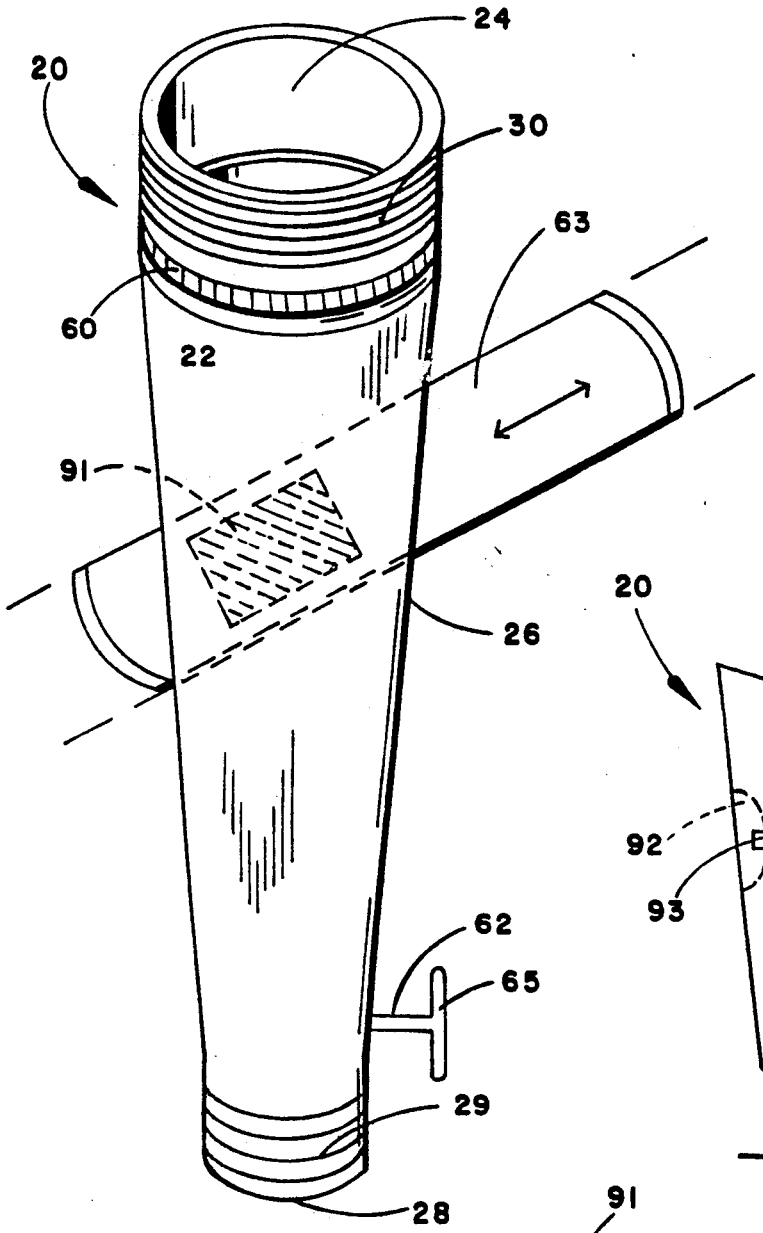
FIG. 14 is a perspective view of the spout device with an exteriorly threaded upper and lower portion and indicates the sliding on/off device in an open position and further indicates an additional on/off device at the lower portion of the spout body.

With the appropriate receiving member now attached to the spout device 20, as seen in FIG. 5, the assembled unit is ready to be detachably fastened to the pouring member or neck of a specific container with its contents to be discharged. The spout device is attached by screwing the assembled unit onto the neck of subject container or is attached by a push/twist method depending upon which plug or adaptor was utilized. The user is advised to have the actuating member 62, as illustrated in FIG. 5, or the on/off mechanism 63, as seen in FIG. 14, in their off positions when the spout device unit is being attached to a container. Actuating members would be in an off position if more than one on/off mechanisms are utilized during the attaching process. Referring again to FIG. 5, actuating member 62 is seen in its on position with its handle 65 vertically in line with the vertical position of spout device 20. Actuating member 62 is further seen, partially with phantom lines, permanently attached to ball valve 84, also shown with phantom lines. The ball valve 84 is illustrated in an open position so that any particular element to be discharged can flow vertically through the ball valve. Also, with reference to FIG. 5, the ball valve housing 88 is additionally shown with phantom lines. Element flow is to be through openings 89 in the ball valve housing and through openings 86 in ball valve 84.

If an operation such as changing motor oil is the function of the spout device, the device would be hand held and each container would be attached to the spout device, then inverted, and its elements discharged upon actuating the on/off mechanism(s) to their on positions, and then detached upon successful element discharge from a container. However, if dispensation of elements from any particular container is to take place with periodic operations of spout device 20 (without interior threading threading in its upper portion) or spout device 56 (with interior threading in its upper portion), a wall surface holding unit 90 is provided which is illustrated in FIG. 11. Upon choosing the necessary plug or plug adaptor combination and subsequently attaching successfully these components to the spout device, the entire unit would be then attached to the container, which has contents to be dispensed, with the on/off mechanism(s) being in an off position. Referring again to FIG. 11 and the bracket 71, the locking device 69, as seen in FIG. 11, would be unlocked and the front one half 73 of bracket 71 would be swung out on hinge 67 approximately 90 degrees. Following this procedure, the container with attached spout device would be inverted (with the on/off mechanism(s) in an off position) and the spout device would then be placed into bracket 71 with the protrusion 60 of spout body 22 of spout device 20 or 56 inserted into recess 61 of bracket 71. The front one half 73 of bracket 71 would then be swung back and locked. Elements could then be dispensed when the on/off mechanism is actuated. If spout device 20 is attached, where one or more on/off mechanisms are utilized, as illustrated in FIG. 14, this spout device could function as a holding unit for a measured amount of element contained therein and the device would be so designed to hold, for instance, one pint of element in the area between the two on/off mechanisms. As the upper mechanism 63, as seen in FIG. 14, is in the on position, the lower mechanism 62 would be in an off position. When this procedure is then reversed, the measured amount only would be released.

Referring now to FIG. 10, dust plate 79 is illustrated and this plate could be placed onto the upper portion 24 of spout device 56 (or device 20, as shown in FIG. 5) as shown in FIG. 12. Following this, interior threading 34, as seen in FIG. 1, of cap 32, also seen in FIG. 1, would be screwed onto exterior threads 30, as seen in FIG. 12, and dust plate 79 would be therefore securely held in place. Naturally, the above described procedure is intended when the spout 20 or the spout 56 is not in use and is mounted to bracket 71. (Note: Spout device 20 is seen in FIG. 5 and has a nonthreaded interior upper portion 24; spout device 56 is seen in FIG. 12 and has an interiorly threaded 58 upper portion 24; spout device 56 is seen again in FIG. 17 with threads 58 in view; spout device 20, with a nonthreaded upper portion interior is additionally seen in FIG. 14). With reference again to FIG. 11, bracket 71 is permanently attached to an extended member 75 where extended member 75 is permanently attached to plate member 77 where plate member 75 is then affixed to a wall surface.

Figure 13:
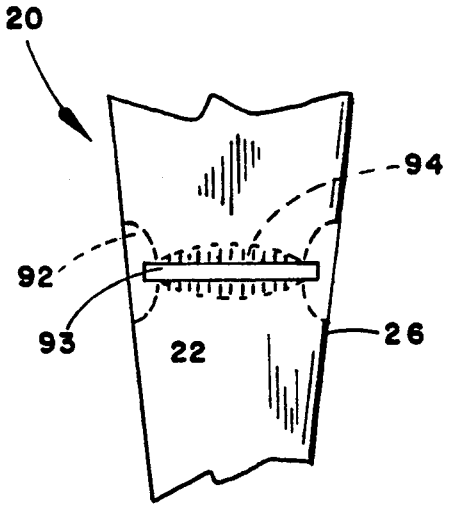
FIG. 13 is a fragmentary view of the spout body intermediate portion where the sliding on/off device enters the body and further indicates, in phantom lines, the thickened interior sidewalls and leakproof seals at the on/off slot opening.
Figure 15:
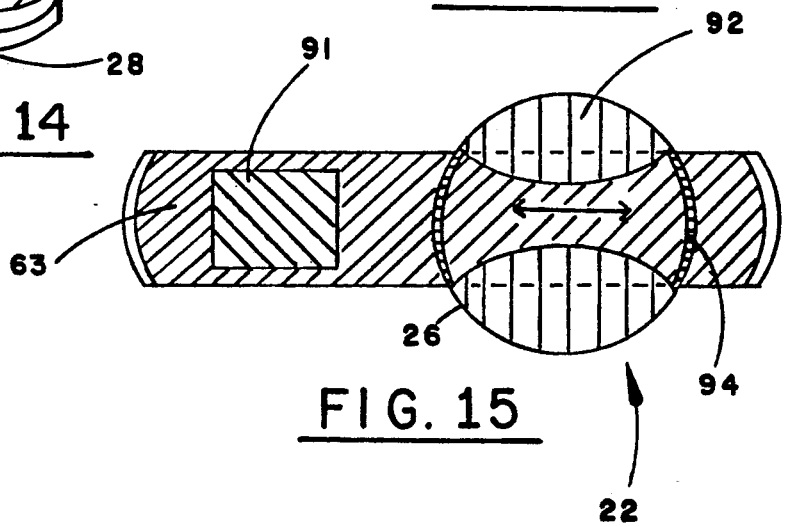
FIG. 15 is a plan view where the sliding on/off device passes through the spout body indicating the sliding device in a closed position with the flow opening on the left outside of the spout body and additionally indicates the thickened interior sidewalls through which the sliding device traverses.

Referring now to FIG. 14, the sliding on/off mechanism 63 is depicted in an on position with the flow opening 91 seen with phantom lines. Additionally, on/off mechanism 62, and its handle 65 is depicted extending outward from the lower part of the intermediate spout body portion 26. Referring to FIG. 13, spout device (20) is illustrated with an opening 93, (for) on/off mechanism 63, shown located within intermediate portion 26. Also, thickened interior sidewalls 92 are depicted with phantom lines as well as the leakproof seals 94 depicted additionally with phantom lines. Viewing now FIG. 15, spout device 22 is illustrated with the on/off mechanism 63 shown in its off position with flow opening 91 located on the outside left of spout intermediate portion 26. Also, the thickened interior sidewalls 92, through which mechanism 63 slides, are depicted. In describing embodiments included within FIGS. 13, 14 & 15 spout intermediate portion 26, of spout body 22 of spout device 20, contains therein an on/off mechanism sliding device 63 projecting through the front and back sidewall portions of spout body portion 26 and further is contained within slots 93 thereby contained within thickened interior sidewalls 92 where the sliding device 63 allowably slides through the spout body so that elements may flow through spout body 22 when flow opening 91 of sliding device 63 is positioned within spout body 22 to allow such. That is, flow opening 91 is in an approximate central position within spout body 22 (as is seen in phantom lines in FIG. 14). Additionally, leakproof seals 94 (as seen in FIG. 13 and FIG. 15) are positioned at slot 93 openings to prevent leakage of elements from body 22 where sliding device 63 traverses through slot 93.

Referring now to FIG. 17, the spout device 56 upper portion 24 is depicted with interior threading 58. Cap 32 is seen attached to upper portion 24. The upper portion 24 chamber is empty; that is, there is no plug insert therein. (NOTE: This view is a comprehensive figure showing the basic idea of the invention and is intended for possible inclusion in an official publication.)

Figure 16:
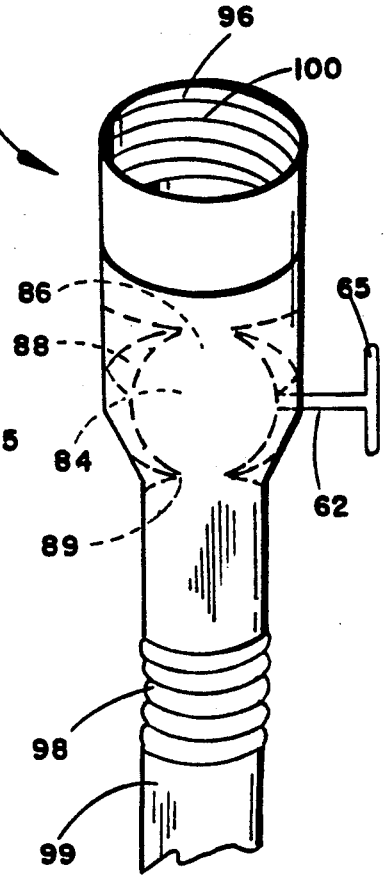
FIG. 16 is an exploded fragmentary view of an interiorly threaded extension member with the actuating member protruding from the upper body portion and the actuating member is further indicated permanently attached to the ball valve shown with phantom lines as well as the ball valve housing also shown with phantom lines.
Figure 18:
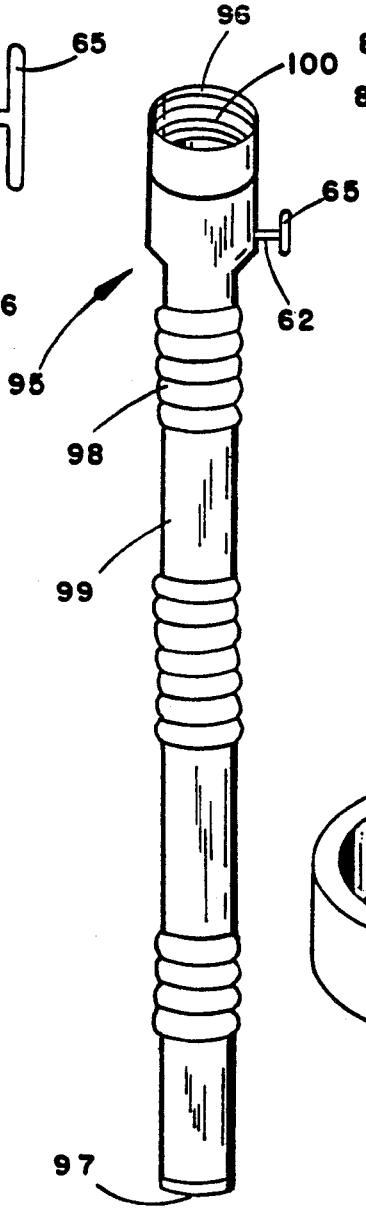
FIG. 18 is a perspective view of the extension member in its entirety.

Referring to FIG. 18, extension member 95 is seen in its entirety with an opening 97 at its bottom. Alternating flexible/rigid portions, 98 and 99 respectively, of the flow tube, are depicted. In FIG. 16, the extension member is illustrated with a fragmented upper view. Upper portion 96 of extension member 95 may be attached by interior threading 100 screwed onto exterior threading 29 of lower spout portion 28 of spout body 20 or 56. Although not shown, the interior upper portion of extension 95 may be fitted with a flexible, resilient material (as are various components of the kit heretofore described) and extension member 95 would then be detachably connected to spout lower portion 28 by a push/twist action (as previously described) for rapid attachment/detachment. Additionally, if only one on/off mechanism is utilized within spout body 20 or 56, on/off mechanism 62 or 63 may be used to discharge a measured amount of element contained within the spout body after the on/off device of spout 20 or 56 is actuated to an off position and the on/off mechanism 62 of extension member 95 is actuated to an on position. It is believed that the element capacity that could be contained within the spout body (or between an upper and lower on/off device) would be approximately one pint as automatic transmission filler tube dipsticks are indicated in one pint increments for adding fluid to the transmission when low. This has historically been a problem, as mentioned earlier, because of the inaccessability of the filler tubes. Additionally, a ball valve 84 is seen with phantom lines in FIG. 16 as well as the ball valve housing 88 also seen with phantom lines. In operation, handle 65 permanently attached to actuating member 62 is gripped and turned which forcibly rotates ball valve valve 84 within ball valve housing 88 to an on position when handle 65 is vertically in line with the vertical position of spout device 20 or 56 or vertically aligned with extension member 95, as shown in FIG. 16 and other figures. Ball valve 84 is shown in an open position so that elements may flow through an opening 86 at its top and bottom where elements flow concurrently through the openings 89 at the top and bottom of the ball valve housing 88. The reader is please advised that the heretofore mentioned operational description concerning the ball valve on/off mechanism is the same when operating this identical mechanism contained within spout device 20 or 56.

Finally, FIG. 19 is a perspective view of an adaptor 50 with lower portion 52 to be detachably fastened to certain plugs, contained within the heretofore described kit, by a push/twist action. Also seen is upper portion 54 and will contain openings of varied diameters for receiving various containers with varieties of neck or pouring member diameters by a push/twist action. Each adaptor selected would have an opening diameter slightly smaller than the container pouring member diameter so that a tight seal is achieved, upon attachment by the push/twist action, since adaptor(s) 50 will be constructed of a flexible, resilient material. Adaptor 50 usage was described in the earlier portion of the detailed description in more detail.

Still an additional embodiment which I will describe but is not included in the appended claims nor in the drawings is a cap 32 alternate which could be detachably fastened to upper portion 24 of spout body 22 of the spout 20 or 56 by threads 34 which could contain an opening, threaded or nonthreaded, for attachment to pouring members of containers. That is, each individual cap included within the kit would have a different diameter at its opening for direct attachment to container necks rather than being utilized exclusively for retaining or securely holding plugs within the upper portion 24 chamber. This option will be analyzed to determine its feasibility for incorporation into the kit of the invention and while there have been shown and described what are considered at present to be the preferred embodiments of the present invention, it will be appreciated by those skilled in the art that modifications of such embodiments may be made. It is therefore desired that the invention not be limited to these embodiments, and it is intended to cover in the appended claims all such modifications as fall within the true spirit and scope of the invention.

I claim:

1. A spout device and kit for discharging containerized fluids comprising: wall mounting means for connection to a vertical surface and the like;

attachment member means for detachably fastening said spout device to said wall mounting means;

a generally tapered hollow spout body housing;

an exteriorly threaded spout upper portion comprising an opening at the extreme upper end of said spout body;

a chamber located within said spout upper portion;

receiving plugs, for insertion into said chamber;

cap means for retaining said plugs inserted into said chamber, and for attachment to said upper portion;

a spout intermediate portion;

an exteriorly threaded spout lower portion comprising an opening at the projection lower end of said spout body;

an on/off flow control means for controlling flow of fluids being dispensed through said spout body which has a passageway therethrough selectively cooperating with said spout body interior allowing fluid flow concurrently through said spout flow openings located at the top and bottom of said housing when said passageway is open to the spout interior;

an extension member comprising a housing, means for detachable connection to a projected member, and said extension member further comprises an opened upper portion and an opened lower portion and an on/off flow control means for regulating fluid flow contained within said upper portion, and which is an integral part thereof; said means comprises a rotatable ball with a passageway therethrough allowing fluid flow concurrently through said flow openings located at the top and bottom of said extension member housing;

an elongated activating member affixed to said rotatable ball for forcibly rotating said ball;

adaptor means for detachable connection to said plugs, to said extension member connection means, and to said cap means;

a dust plate for placement onto said spout body upper portion.

2. The invention of claim 1 wherein said attachment member means is comprised of an approximate circular shaped exterior portion while its interior portion is formed to correspond approximately to the exterior shape of said spout body.

3. The invention of claim 1 wherein said on/off spout body flow control means is comprised of a sliding device projecting through at least one sidewall portion of said spout body.

4. The invention of claim 1 wherein said plugs and said adaptor means are comprised of a substantially rigid material.

5. The invention of claim 1 wherein said plugs and said adaptor means are comprised of a flexible, resilient material.

6. The invention of claim 1 wherein said plugs are comprised of, in combination, a substantially rigid material comprising its outer circumferential area and a flexible, resilient material comprising its inner circumferential area.

7. The invention of claim 1 wherein said cap means comprises a continuous elongated wedge shaped protrusion permanently affixed to an underside upper surface of said cap means

8. A method of utilizing a spout device in conjunction with a wall surface holding unit, when discharging elements from a container, comprising the steps of:

providing wall mounting means for connection to a vertical surface and the like;

providing attachment member means for detachably fastening said spout device to said wall mounting means;

providing a generally tapered hollow spout body;

providing an exteriorly threaded spout upper portion comprising an opening at the extreme upper end of said spout body;

providing a chamber located within said spout upper portion;

providing receiving plugs, for insertion into said chamber;

providing cap means for retaining said plugs inserted into said chamber; and for attachment to said upper portion;

providing a spout intermediate portion;

providing an exteriorly threaded spout lower portion comprising an opening at the projected lower end of said spout body;

providing an on/off means, for regulating fluid flow through said spout body;

providing an elongated activating member portion affixed to said means for regulating to initiate control of fluid flow;

providing adaptor means for detachable connection to said plugs, and to said cap means;

connecting said container to said spout device;

connecting said spout device and said container, in combination, to said attachment member means; and dispensing containerized elements through said spout device by activating said means for regulating fluid flow.

9. A method of utilizing a spout device in conjunction with a wall surface holding unit, when discharging elements from a container, in accordance with claim 8 wherein said on/off flow control means is comprised of one of 1.) a sliding device with its elongated activating portion projecting through the sidewall portion of said spout body, or 2.) a rotatable ball with a passageway therethrough with its elongated activating portion projecting through the sidewall portion of said spout body.

10. A method of utilizing a spout device in conjunction with a wall surface holding unit, when discharging elements from a container, in accordance with claim 8 wherein said attachment member means is comprised of an approximate circular shaped exterior portion while its interior portion is formed to correspond approximately to the exterior shape of said spout body.

11. A method of utilizing a spout device in conjunction with a wall surface holding unit, when discharging elements from a container, in accordance with claim 8 wherein said plugs and said adaptor means are comprised of a substantially rigid material.

12. A method of utilizing a spout device in conjunction with a wall surface holding unit, when discharging elements from a container, in accordance with claim 8 wherein said plugs and said adaptor means are comprised of a flexible, resilient material.

13. A method of utilizing a spout device in conjunction with a wall surface holding unit, when discharging elements from a container, in accordance with claim 8 wherein said plugs are comprised of, in combination, a substantially rigid material comprising its outer circumferential area and a flexible, resilient material comprising its inner circumferential area.

14. A method of utilizing a spout device in conjunction with a wall surface holding unit, when discharging elements from a container, in accordance with claim 8 wherein said cap means comprises a continuous elongated wedge shaped protrusion permanently affixed to an underside upper surface of said cap means.

* * * * *